US009085448B2

(12) United States Patent
Hertzog

(10) Patent No.: US 9,085,448 B2
(45) Date of Patent: Jul. 21, 2015

(54) CRIMPING DEVICE

(75) Inventor: Jean Hertzog, Hesingue (FR)

(73) Assignee: F. Hoffmann-La Roche AG, Basel (CH)

( * ) Notice: Subject to any disclaimer, the term of this patent is extended or adjusted under 35 U.S.C. 154(b) by 2 days.

(21) Appl. No.: 12/322,475

(22) Filed: Feb. 2, 2009

(65) Prior Publication Data

US 2009/0199510 A1 Aug. 13, 2009

(30) Foreign Application Priority Data

Feb. 8, 2008 (EP) ..... 08101419

(51) Int. Cl.
*B67B 3/10* (2006.01)
*B67B 3/12* (2006.01)
*B67B 3/18* (2006.01)

(52) U.S. Cl.
CPC .... *B67B 3/12* (2013.01); *B67B 3/18* (2013.01)

(58) Field of Classification Search
USPC ..... 53/334, 331, 329, 335, 351, 306, 308
See application file for complete search history.

(56) References Cited

U.S. PATENT DOCUMENTS

| | | | | |
|---|---|---|---|---|
| 2,668,650 A * | 2/1954 | Wilson | 53/359 |
| 2,875,566 A * | 3/1959 | Sevenpifer | 53/334 |
| 3,336,728 A | 8/1967 | Monaco | |
| 3,672,121 A * | 6/1972 | Kawaminani | 53/351 |
| 3,713,268 A * | 1/1973 | Gess | 53/334 |
| 3,775,944 A * | 12/1973 | Roberts | 53/334 |
| 3,831,344 A * | 8/1974 | Over | 53/329 |
| 3,964,234 A | 6/1976 | Hurst | |
| 5,111,635 A * | 5/1992 | Neber | 53/334 |

FOREIGN PATENT DOCUMENTS

| | | |
|---|---|---|
| FR | 978 537 | 4/1951 |
| JP | B-S50-008390 | 4/1975 |
| JP | S59-114000 | 2/1986 |

OTHER PUBLICATIONS

European Search Report, Application No. EP 08 10 1419.3, date of completion of the search Sep. 4, 2008.

* cited by examiner

*Primary Examiner* — Sameh Tawfik
(74) *Attorney, Agent, or Firm* — Mintz, Levin, Cohn, Ferris, Glovsky and Popeo, P.C.

(57) ABSTRACT

A crimping device for crimping a cap around a flange of a container is provided. The crimping device comprises a disc having a first disc member and a second disc member adjacent the first disc member, wherein the second disc member extends outwardly beyond the first disc member and has a hardness lesser than that of the container and a motion device for producing a relative movement between the disc and the flange of the container so as to effect crimping of the cap around the flange.

10 Claims, 3 Drawing Sheets

CRIMPING DEVICE

CROSS-REFERENCE TO RELATED APPLICATIONS

The present application claims priority to European Patent Application No. 08101419.3, filed Feb. 8, 2008, the entire content of which is herein incorporated by reference.

FIELD OF THE DISCLOSURE

Devices for crimping a cap around a flange of a container are provided.

BACKGROUND OF THE DISCLOSURE

Crimping devices are widely used in industry to seal containers. For example, in production lines for the production of certain pharmaceutical products, a container having a flange is first filled with the product (e.g., a liquid) and then a stopper (septum) is inserted into the opening of the container. Finally, the container is sealed by a cap (e.g., made of aluminium) through crimping the cap around the flange of the container. The crimping is performed by a crimping device comprising a circular disc, which deforms the cap beneath the flange of the container while the container is rotated about its axis.

A known crimping device has a circular disc made of hardened steel exhibiting a high durability. The circular disc is arranged so as to only contact (and deform) the cap to be crimped around the flange. But it may occur that during the process of crimping, the circular disc made of hardened steel strikes against the container anyway. Since the containers are often glass vials, such striking of the circular disc with the glass vials may result in scratches being formed on the glass vials. These scratches may weaken or damage the glass vials or even break the glass vials. Cracks or fissures in the glass vial may cause the vial's contents to leak out. Any of these occurrences could cause contamination of the vial's contents.

SUMMARY OF THE DISCLOSURE

It is an object of at least some of the embodiments described herein to provide a crimping device for crimping a cap around a flange of a container without damaging the container. This object is achieved by the crimping devices described herein Embodiments of a crimping device for crimping a cap around a flange of a container are described herein. In some embodiments, the device comprises a disc having a first disc member and a second disc member adjacent the first disc member. The second disc member extends outwardly beyond the first disc member. The second disc member also has a hardness less than that of the container. The device may include a motion device for producing a relative movement between the disc and the flange of the container so as to effect crimping of the cap around the flange. The first and second disc members are arranged such that during crimping the first disc member contacts the cap so as to crimp the cap around the flange while the second disc member does not contact the cap.

Therefore, if at all, only the second disc member can strike against the container during crimping. Thus, the second disc member effectively prevents the first disc member from striking against the container, while crimping of the cap around the flange of the container is reliably performed by the first disc member contacting the cap. The first disc member can still be made of hardened steel, like in the known crimping device, and can therefore exhibit high durability while at the same time damages to the container (e.g. glass vial) are prevented.

In some embodiments of the crimping device, the first and second disc members are circular disc members having a common rotational axis, with the diameter of the second disc member being greater than the diameter of the first disc member. The use of circular disc members is a simple way for crimping caps around flanges of containers with circular openings and circular flanges, since circular relative movements in a production line are comparatively easy to realize and implement from a structural point of view.

In some embodiments of the crimping device, the motion device for producing a relative movement between the disc and the flange of the container are designed such that the container holding the cap to be crimped is rotated around its rotational axis while the disc is in contact with the cap. Crimping is effected all around the container and the container gets sealed all around its flange. This also constitutes a simple way of implementing the relative movements in a production line from a structural point of view.

In some embodiments of the crimping device, the first disc member comprises a pin and the second disc member comprises a hole. The pin of the first disc member is press-fitted into the hole of the second disc member. This is a simple way of securely mounting the first and second disc members to one another so as to form the disc of the crimping device.

In some embodiments, the crimping device, comprises screws fixing the second disc member to the first disc member. These screws enable the first disc member and the second disc member to be mounted together and to make sure that the second disc member extends radially outwardly beyond the first disc member all around the first disc member to avoid damage to the container by the first disc member. Replacement of any of the disc members can also be performed in a simple way, by unscrewing the second disc member from the first disc member.

In some embodiments of the crimping device, the second disc member extends radially outwardly beyond the first disc member by 0.1 mm to 0.4 mm and, in particular, by about 0.2 mm. This distance is suitable to make sure that the first disc member does not strike against the container.

In some embodiments of the crimping device, the second disc member has a thickness in the range of 1 mm to 10 mm and, in particular of about 2 mm. The specified thickness of the second disc member is suitable to prevent deformation of the second disc member caused by striking against the container.

In some embodiments of the crimping device, the second disc member is made of a suitable material, such as ERTALYTE® PET (Poly (ethylene terephthalate)). This material is solid and durable and will not damage the (glass) container. A suitable alternative material for the second disc member is PEEK (polyetheretherketone), which can be easily sterilized.

BRIEF DESCRIPTION OF THE FIGURES

Further advantageous aspects of the crimping device become evident in view of the following detailed description of the specific embodiments with the aid of the drawings.

DETAILED DESCRIPTION OF THE EMBODIMENTS

Figure 1:
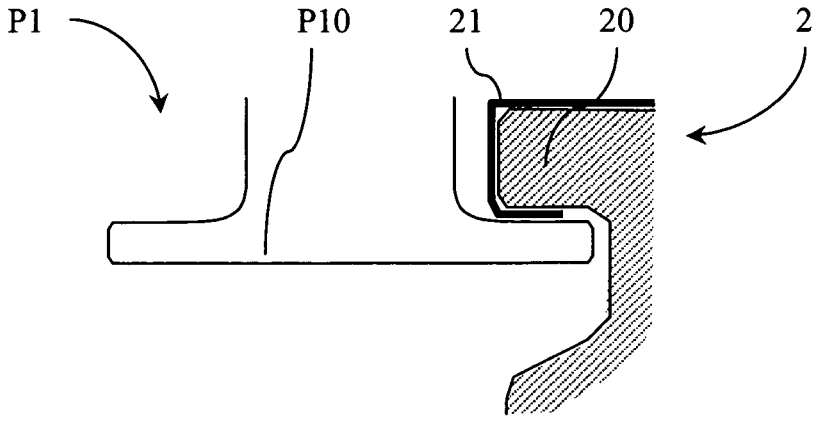
Fig. 1 (Prior Art)
FIG. 1 shows a prior art crimping device and a container.

FIG. 1 shows a prior art crimping device P1. Crimping device P1 comprises a disc P10 made of hardened steel exhibiting a high durability. Disc P10 is shown during crimping a cap 21 around a flange 20 of a container 2. Container 2 is positioned next to disc P10, with disc P10 being arranged beneath flange 20. Container 2 is then rotated about its axis and disc P10 crimps cap 21 inwardly against flange 20 of container 2, thus sealing container 2. As shown in FIG. 1, disc P10 is arranged so as to only contact cap 21. But it may occur that during the process of crimping disc P10 strikes against container 2. Since the containers 2 are often glass vials, such striking of disc P10 against the glass vials may result in scratches being formed on the glass vials. These scratches may weaken or even damage the glass vials or even break the glass vials.

Figure 2:
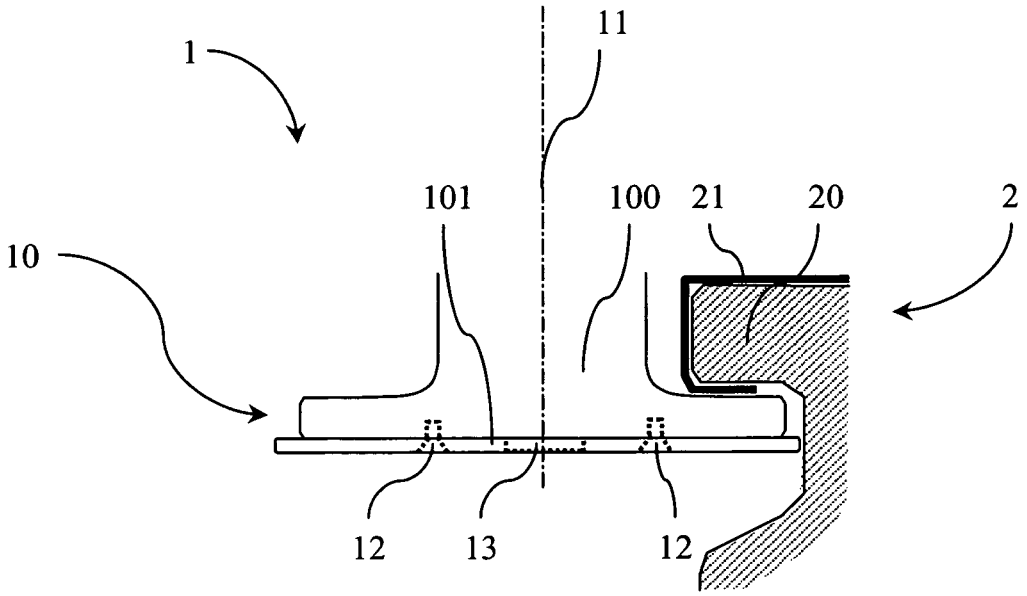
FIG. 2 shows an embodiment of a crimping device and a container.

FIG. 2 shows an embodiment of a crimping device 1 according to the invention. Crimping device 1 comprises a disc 10. Disc 10 comprises a first disc member 100 and a second disc member 101. Second disc member 101 abuts against first disc member 100 and extends outwardly beyond first disc member 100. Also shown in FIG. 2 is a container 2 with a flange 20 and a cap 21 (e.g., made of aluminium) covering the opening of container 2. Cap 21 is being crimped around flange 20. First disc member 100 and second disc member 101 are circular disc members with a common rotational axis 11, with the diameter of second disc member 101 being greater than the diameter of first disc member 100. Second disc member 101 extends radially outwardly beyond first disc member 100 by 0.1 mm to 0.4 mm and, in particular, by about 0.2 mm. Second disc member 101 has a thickness in the range of 1 mm to 10 mm and, in particular, of about 2 mm. Second disc member 101 is made of a suitable material, such as ERTALYTE® PET (Poly (ethylene terephthalate)), which can be obtained from Angst+Pfister AG, Zürich, Switzerland or PEEK (polyetheretherketone). Crimping device 1 also comprises a motion device for producing a relative movement between the disc 10 and the flange 20 of the container 2 (see arrow 4 in FIG. 4), so that container 2 holding cap 21 is rotated around its rotational axis, while first disc member 100 is in contact with cap 21. Container 2 is rotated all around its rotational axis to crimp cap 21 inwardly against flange 20 by deforming cap 21. Disc 10 is arranged so as to only contact (and deform) cap 21. But it may occur that during the process of crimping, disc 10 strikes against container 2 anyway. In such case, only second disc member 101 which extends radially outwardly beyond the first disc member 100, strikes against container 2. First disc member 100 does not strike against container 2 at all. As second disc member 101 has a hardness smaller than that of container 2, no damage to container 2 occurs when second disc member 101 strikes against container 2.

Crimping device 1 may comprise screws 12 fixing second disc member 101 to first disc member 100, or alternatively first disc member 100 may comprise a pin 13 and second disc member 101 may comprise a hole, wherein pin 13 of first disc member 100 is press-fitted into the hole of second disc member 101.

Figure 3:
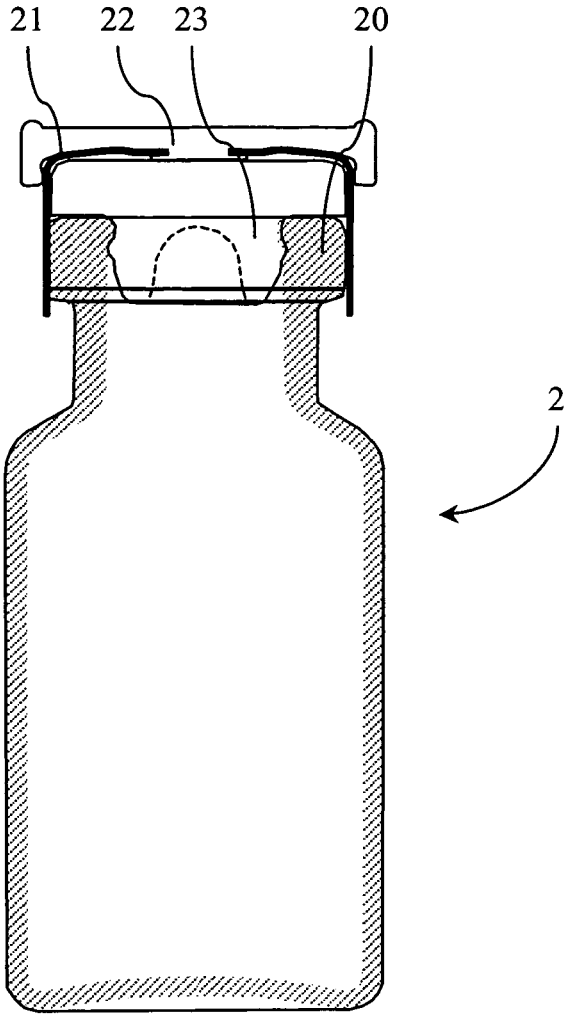
FIG. 3 shows an embodiment of a container with a cap before crimping.

FIG. 3 shows an embodiment of a container 2 with a flange 20 and a cap 21 before crimping. Also shown is a stopper (septum) 23 and a protective plastic button 22 forming a part of the cap 21. During production, once container 2 has been filled with a product, stopper 23 is inserted in the opening of container 2 so as to close container 2. Subsequently, cap 21 and protective button 22 are arranged over stopper 23 and flange 20 of the container 2. Cap 21 is now ready for crimping. Protective button 22 prevents the stopper 23 from damage and indicates that the container has not been opened yet.

Figure 4:
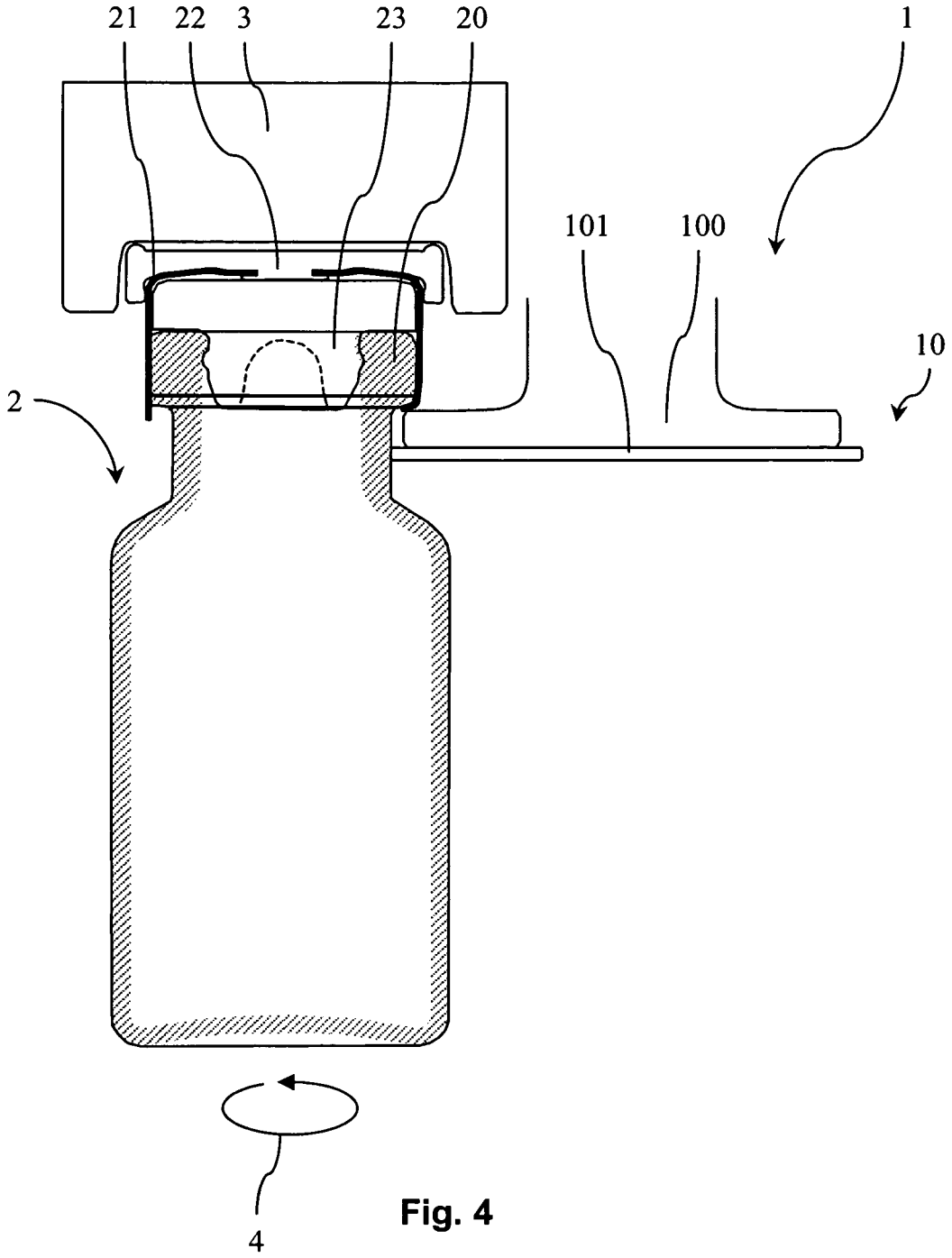
FIG. 4 shows the container of FIG. 3 and the crimping device of FIG. 2 during crimping.

FIG. 4 shows a cross-section of container 2 of FIG. 3 and crimping device 1 of FIG. 2. Crimping device 1 comprises disc 10 with first disc member 100 and second disc member 101. Container 2 is shown with its flange 20, cap 21, protective button 22 and stopper (septum) 23. In addition, a retainer 3 may holds container 2 in place during crimping. FIG. 4 shows on the right hand side container 2 with cap 21 being crimped, while on the left hand side cap 21 is not yet crimped.

Other alternative features of the crimping device according to the invention are conceivable, including other possibilities of mounting the second disc member to the first disc member (e.g., gluing the second disc member to the first disc member) and holding the container fixedly in place while the disc of the crimping device rotates around the container to perform crimping of the cap.

What is claimed is:

1. A crimping device for crimping a cap around a flange of a container having a rotational axis, the crimping device comprising:

a disc having a first disc member performing the crimping function during operation of the crimping device and a second disc member adjacent the first disc member, wherein the second disc member extends outwardly beyond the first disc member and has a hardness lesser than glass; and a motion device producing a relative movement between the disc and the flange of the container during operation of the crimping device so as to effect crimping of the cap around the flange, wherein, during operation of the crimping device, the first disc member contacts the cap to crimp the cap around the flange while the second disc member does not contact the cap, wherein the relative movement between the disc and the flange of the container during operation of the crimping device is such that the container is rotated around its rotational axis while the first disc member is in contact with the cap, and wherein during operation of the crimping device the second disc member prevents the first disc member from striking against the container.

2. The crimping device according to claim 1, wherein the first disc member and the second disc member are circular disc members having a common rotational axis, with the diameter of the second disc member being greater than the diameter of the first disc member.

3. The crimping device according to claim 1, wherein the motion device for producing a relative movement between the disc and the flange rotates the container about its rotational axis while the disc is in contact with the cap.

4. The crimping device according to claim 1, wherein the first disc member includes a pin that is press-fitted into a hole of the second disc member.

5. The crimping device according to claim 1, further comprising screws fixing the second disc member to the first disc member.

6. The crimping device according to claim 1, wherein the second disc member extends radially outward beyond the first disc member by 0.1 mm to 0.4 mm.

7. The crimping device according to claim 6, wherein the second disc member extends radially outward beyond the first disc member by 0.2 mm.

8. The crimping device according to claim 1, wherein the second disc member has a thickness in the range of 1 mm to 10 mm.

9. The crimping device according to claim 8, wherein the second disc member has a thickness of 2 mm.

10. The crimping device according to claim 1, wherein the second disc member is made of ERTALYTE® PET or PEEK.

* * * * *